United States Patent [19]

Ausnit

[11] Patent Number: 4,660,259

[45] Date of Patent: Apr. 28, 1987

[54] TWIST RESISTANT RECLOSABLE EXTRUDED PLASTIC FASTENER

[75] Inventor: Steven Ausnit, New York City, N.Y.

[73] Assignee: Minigrip, Inc., Orangeburg, N.Y.

[21] Appl. No.: 891,945

[22] Filed: Aug. 1, 1986

[51] Int. Cl.[4] ..... A44B 19/00; B65D 33/24

[52] U.S. Cl. ..... 24/587; 24/576; 24/704; 383/64

[58] Field of Search ..... 24/587, 576, 578, 704; 383/63, 64, 35

[56] References Cited

U.S. PATENT DOCUMENTS

| | | | |
|---|---|---|---|
| 2,794,228 | 6/1957 | Teher | 24/576 |
| 3,633,642 | 1/1972 | Siegel | 383/64 |
| 3,808,649 | 5/1974 | Ausnit | 383/63 |
| 3,886,633 | 6/1975 | Ausnit | 24/576 |
| 3,918,131 | 11/1975 | Ausnit | 24/576 |

*Primary Examiner*—Victor N. Sakran

[57] ABSTRACT

An extruded plastic reclosable fastener strip has a base from which extends a stem and a resiliently flexible, foldable hook flange projecting in normal position obliquely from the distal end of the stem toward, but spaced from, a stiff backup shoulder rib extending from the base in the same direction as, and substantially spaced from, the stem. The rib is about the same length as the stem, and the spacing between the rib and the stem provides a groove socket of ample dimensions relative to the foldable hook flange and the stem so that in a fastener closing maneuver a hook flange and a stem of a complementary profile of a companion fastener strip can be received in assembly slidably between the rib and the foldable hook flange by folding of the foldable hook flange substantially completely toward the stem until the hook flanges pass one another and the foldable hook flange then snaps back to the oblique position for interlocking with the profile hook flange of the companion fastener strip in a manner to resist separation of the interlocked strips due to twisting distortions.

20 Claims, 4 Drawing Figures

TWIST RESISTANT RECLOSABLE EXTRUDED PLASTIC FASTENER

BACKGROUND OF THE INVENTION

This invention relates to reclosable extruded plastic fasteners of the kind having interlockably cooperative fastener strips which are suitable for convenient manipulation into closed and open modes, and according to the present invention will thoroughly resist unintended opening due to twisting of the fastener assembly.

Heretofore, extruded plastic reclosable fasteners having complementary interlockable hook profiles have been successfully developed for wide ranging market utility.

One popular form of such reclosable fasteners has been the type wherein an essentially arrow-shaped profile is interlockably engagable in a complementary groove-shaped profile. While numerous patents disclosing this type of fastener could be listed, U.S. Pat. No. 3,808,649 has been selected as representative. While, in general, this type of fastener is of the readily manipulatable type for opening and closing, U.S. Pat. No. 3,808,649 combines the readily closing manipulation feature with permanent closure requiring either destruction or assistance of a tool for opening the fastener.

Extruded plastic fasteners of the kind to which the present invention is especially directed are represented in U.S. Pat. Nos. 3,633,642 and 3,886,633, wherein complementary fastener strips have monohook profiles which snap together and are held against unintentional displacement by backup flanges. In the fasteners disclosed by these patents, the interlocking hooks are relatively short and have reinforced fairly massive crown structure so that due to the relatively stiff action of the hooks, the backup flange structure as well as the profile stems must flex substantially both when snapping the fastener strips together and when separating the fastener strips.

A problem that has been encountered with respect to fasteners of especially the form shown in U.S. Pat. No. 3,633,642 resides in that under twisting conditions, the hook profiles of the fasteners may tend to release, and the fastener thus be unintentionally opened. It is to the alleviation of this problem that the present invention has been devised.

SUMMARY OF THE PRESENT INVENTION

An important object of the present invention is to provide an extruded plastic fastener strip construction wherein cooperating monohooks are especially constructed and arranged for cooperative resistance to release due to twisting of the fastener assembly in which the strip is incorporated.

Another object of the invention is to provide a new and improved extruded plastic fastener construction which will thoroughly resist opening by twisting of the fastener, but which can be readily manipulated for closing and opening as desired.

Pursuant to the present invention, there is provided an extruded plastic fastener strip adapted for reclosable cooperation with a complementary fastener strip, and comprising a base from which extends a profile including a stem and a resiliently flexible, foldable hook flange projecting in normal position obliquely from the distal end of the stem toward, but spaced from, a stiff backup shoulder rib extending from the base in the same direction and substantially spaced from the stem, the rib being about the same length as the stem and the spacing between the rib and the stem providing a groove of ample dimensions relative to the foldable hook flange and the stem so that in a fastener closing maneuver a hook flange and stem of a complementary profile of a companion fastener strip can be received slidably between the rib and the foldable hook flange by folding of the foldable hook flange toward the stem until the hook flanges pass one another and the foldable hook flange then snaps back to the oblique position for interlocking with the profile hook flange of the companion fastener strip.

BRIEF DESCRIPTION OF THE DRAWINGS

Other objects, features and advantages of the invention will be readily apparent from the following description of a representative embodiment thereof, taken in conjunction with the accompanying drawing, although variations and modifications may be effected without departing from the spirit and scope of the novel concepts embodied in the disclosure, and in which.

DETAILED DESCRIPTION

Figure 1:
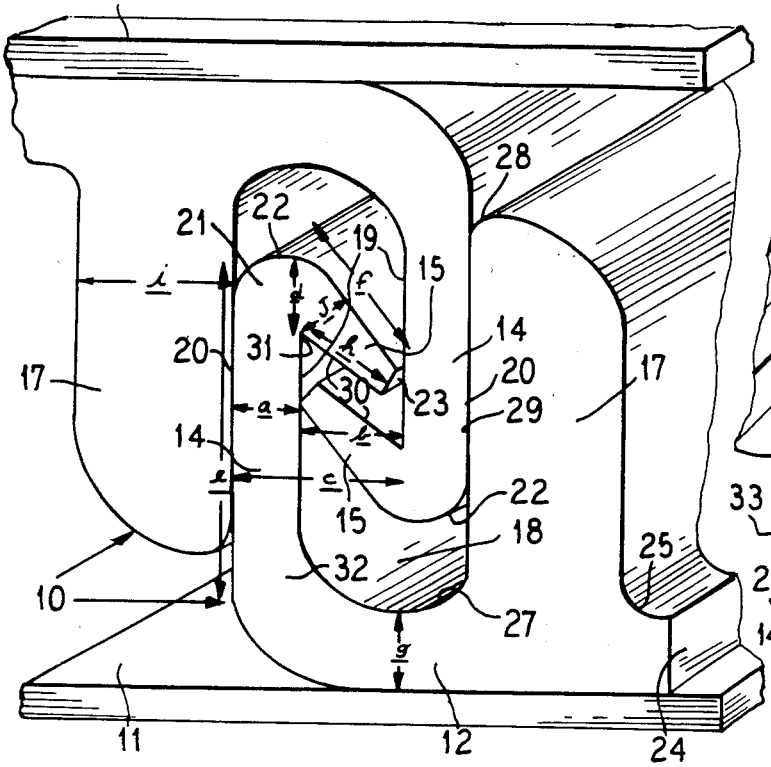
FIG. 1 is a representative cross sectional detail view of a monohook fastener structure according to the present invention.

A fastener assembly as shown in the drawings comprises cooperating extruded plastic fastener strips 10 which may be attached to respective sheets or panels 11 to be secured in a readily reclosable manner. It will be obvious that the disclosed fastener (also sometimes referred to as a zipper) may be extruded in various sizes, proportionate to the particular uses to which put, such as for sheet connection purposes as in tarpaulins, field covers, tapestry and drapery hangings, top closures for containers such as bags and sacks, and the like. In any such uses, the fastener assembly may be subjected to twisting stresses which the fastener strips 10 of the present invention are especially constructed to resist and avoid unintentional opening of the fastener assembly. Although as shown, the fastener strips 10 are extrusions formed separately from the panels 11, and attached thereto as by means of fusion welding or adhesive means, it is obvious that where practicable the fastener strips may be extruded integrally with the panels 11. Either of those alternative techniques are well known in this art.

In the preferred example disclosed, each of the fastener strips 10 is identical in construction so that the strips can be extruded from a single die in a continuous strip which can then be cut into sections of whatever desired length and merely by reversing one strip section relative to the other will be placed in reclosable relation. Alternately several fastener strips can be extruded at one time from one or more dies. Each of the strips 10 comprises a base 12 from which extends a stem 14. A resiliently flexible, foldable hook flange 15 projects obliquely from the distal end of the stem 14 toward, but spaced from, a stiff backup shoulder rib 17 which extends from the base 12 in the same direction as and substantially spaced from the stem 14. The rib 17 is about the same length as the stem 14, but may be slightly longer, as shown, to afford a greater backup length for the cooperating fastener stem 14. The spacing between the rib 17 and the stem 14 provides a socket groove 18 of ample dimensions relative to the hook flange 15 and the stem 14, so that in a fastener closing maneuver, the hook flange 15 and stem 14 of a complementary profile of a companion fastener strip can be received slidably between the rib 17 and the foldable hook flange 15 by folding of the foldable hook flange 15 toward the stem 14 until the hook flanges pass one another and the foldable hook flange 15 snaps back to the oblique position for interlocking with the profile hook flange of the companion strip.

For optimum results, the several elements of each of the fastener strips 10 are relatively constructed and proportioned in a preferred manner having regard to various respective dimensions, as will be explained for illustrative convenience by reference to lower case lettered dimensional parameters which apply to each of the strips 10 with equal effect.

Thickness dimension a of the stem 14 is measured between preferably parallel respectively inside and outside faces 19 and 20 of the stem, and the thickness is substantially uniform throughout the major extent of the length of the stem.

Dimension b relates to the space between the confronting inside faces 19 of the companion strips 10 in the closed fastener assembled relation of the strips.

Dimension c is the sum of dimensions a and b and represents the width of the socket 18.

A relatively thick crown 21 from which the foldable hook flange 15 extends has a curvate crown surface 22, a radius of curvature dimension d which is desirably about the same as the stem thickness dimension a. It may be pointed out that by preference the dimension b is about two times the dimension d, or a. Stated another way, the dimension b is about the sum of a and d.

The dimension e represents the length of the stem 14 from the top of the crown 21 to the level of the inside surface of the base 12.

Dimension f is the outside length of the hook flange 15 taken in a straight line between free tip 23 of the hook flange and the top point of curvilinear crown surface 22. Note that the dimension e is about 2f plus $\frac{1}{2}$a.

Dimension g represents the thickness of the base 12 and desirably is about the thickness of the stem a plus 20%.

Dimension h is the length of the inside surface of the hook flange 15, and is desirably about the same as the spacing dimension b, or about two times the thickness of dimension a. The dimension f is about the sum of the dimensions h and d.

Dimension i is the thickness of the rib 17 and is desirably about the same as the dimension f. It may also be pointed out that, as shown, the dimension e is desirably two times f plus $\frac{1}{2}$ of a.

Dimension j across the thickness of the base of the hook flange 15 is preferably twice the thickness of the tip end toward which the tapering surfaces of the hook flange 15 converge.

A few additional desirable structural features of the fastener strips 10 may also be observed, including a width extension 24 of the base 12 beyond the outer side of the rib 17. This extension 24 meets the outside base surface of the rib 17 on a fillet 25 and provides, in effect, a bracing reinforcement which assists in stiffening the rib 17 against undesirable outward deflection. A fillet 27 at the inside juncture of the rib 17 with the base 12 serves the same function and cooperates with the fillet 25 in resisting torsional or twisting deflections of the rib. A chamferred or rounded leadin surface 28 at the top inner side of the crown of the rib 17 facilitates assembly of the companion strip profile into the socket 18, in cooperation with the transversely curvilinear crown 22. A flat inner surface 29 of the rib 17 provides a broad wide surface slidably engagable in backup relation with the surface 20 of the companion fastener strip profile stem 14.

For resilience and folding efficiency, the hook flange 15 is of a generally tapered construction of about twice the thickness at juncture with the crown 21, as compared to the thickness of the tip 23 which is desirably of a blunt truncated form. Preferably straight inner surface 30 of the hook flange 15 desirably joins the inner surface 19 of the associated stem 14 at a relatively accute angle juncture 31. Thereby, the hook flange 15 is adapted to fold closely toward the stem surface 19 with the hook flange surface 30 substantially parallel thereto.

At its juncture with the base 12, the stem 14 is desirably substantially thickened as indicated at 32, whereby to further improve resistance to twisting of the strip 10.

Figure 2:
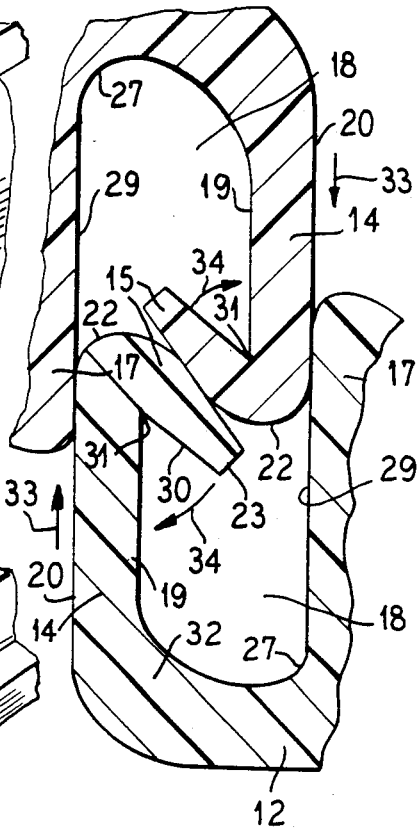
FIG. 2 is a view similar to FIG. 1, but showing the monohook profiles at the beginning of a fastener closing operation.

As shown in FIG. 2, when the strips 10 are brought into registration for interlocking, the crown ends of the profile stems 14 enter into the outer ends of the sockets 18 and shoulder against the outer end portions of the rib surfaces 29, with the outwardly facing surfaces of the hook flanges 15 nested against one another in a camming relation. Upon application of relative assembly pressure, as indicated by the arrows 33, toward the fastener strips 10, the profile stem surfaces 20 will slidably advance inwardly as backed up against the rib surfaces 29. The cammingly engaged hook flanges 15 will deflect one another, as indicated by directional arrows 34, toward the stem surfaces 19 of the companion strip in each instance.

Figure 3:
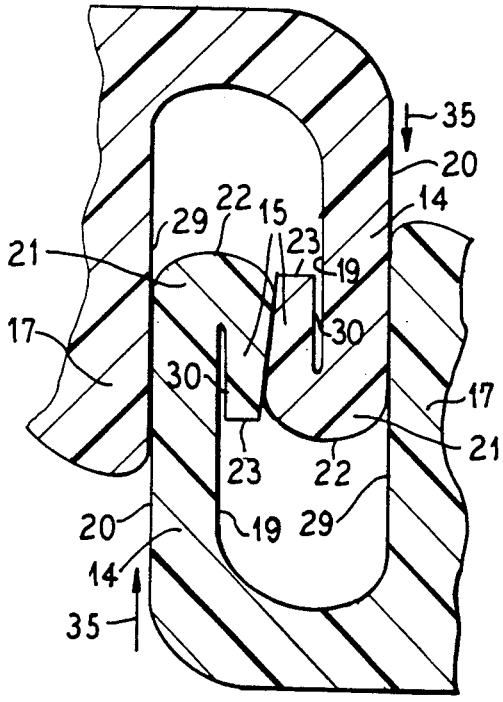
FIG. 3 is a view similar to FIG. 2, but showing the elements after the closing maneuver has progressed part way.

Continuing relative assembly movement of the fastener strips, as indicated by the arrows 35 in FIG. 3, causes the hook flanges 15 to foldably deflect one another toward the respective stems 14. Then continuing assembly force causes the deflected, folded hook flanges to pass one another until, as indicated by directional arrows 37 in FIG. 4, the tips 23 of the pull flanges 15 clear one another and the pull flanges snap into the normal oblique position for interhooking of the hook flanges. The sockets 18 are of sufficient depths to provide clearance for passing of the hook flanges 15 inwardly past one another into the expanded interhooked relation.

Figure 4:
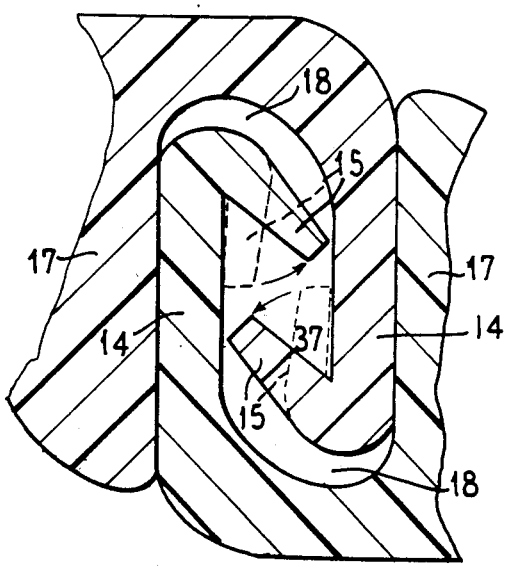
FIG. 4 is an illustrative view similar to FIG. 1, demonstrating the action of the foldable hook flanges of the cooperating fastener profiles.

It will be noted in FIGS. 1 and 4, that by the relatively sharply angular oblique positions of the hook flanges 15, and the relatively large confronting areas of the surfaces 30 of the hook flanges, as well as the solid backup provided by the ribs 17 for the stems 14 adjacent to which the tips 23 of the hook flanges are located in the assembly, separation, that is opening, of the fastener assembly is thoroughly resisted when the assembly is subjected to twisting strains. Nevertheless, there can be adequate resilient yielding of the components of the assembly when a suitable separating mechanism is applied.

Although for illustrative purposes a single stem/foldable flange/rib profile arrangement has been shown for each of the cooperating fastener strips 10, it will be clear that multiples of as many as desired of the stem/foldable flange/rib arrangements may be provided on each strip to meet various practical requirements.

It will be understood that variations and modifications may be effected without departing from the spirit and scope of the novel concepts of the present invention.

I claim as my invention:

1. An extruded plastic fastener strip adapted for reclosable cooperation with a complementary fastener strip, and comprising:

a base from which extends a stem and a resiliently flexible, foldable hook flange projecting in normal position obliquely from the distal end of the stem toward a stiff backup shoulder rib extending from the base in the same direction as and substantially spaced from said stem;

said hook flange being of greater length than the thickness of said stem and being resiliently flexible for folding substantially completely toward the stem; and said rib being about the same length as the stem and. the spacing between the rib and the stem providing a groove providing a socket of ample dimensions both in width and depth relative to the foldable hook flange and the stem so that in a fastener closing maneuver a hook flange and stem of a complementary profile of a companion fastener strip can be received slidably between the rib and the foldable hook flange by said folding of the foldable hook flange toward the stem until the hook flanges pass one another and the foldable hook flange then snaps freely back toward the normal oblique position for interlocking with the profile hook flange of the companion fastener strip.

2. A fastener strip according to claim 1, wherein said hook flange has an inner substantially straight surface which meets the adjacent surface of said stem at an acute angle so that said surfaces can lie close to one another when the hook flange is folded toward the stem.

3. A fastener strip according to claim 1, wherein said stem is of substantially uniform thickness throughout the major extent of its length.

4. A fastener strip according to claim 3, including a thickened reinforcing juncture of said stem with said base.

5. A fastener strip according to claim 1, wherein said hook flange joins the stem at a thickened juncture crown.

6. A fastener strip according to claim 1, wherein said backup shoulder rib has a stiffening reinforcement juncture with said base.

7. A fastener strip according to claim 6, wherein said stiffening reinforcement juncture comprises a fillet.

8. A fastener strip according to claim 6, wherein said stiffening reinforcement juncture includes a base extension and a fillet at juncture of the rib and the extension.

9. A fastener strip according to claim 1, wherein both said stem and said rib have reinforcing juncture fillets with said base.

10. An extruded plastic reclosable fastener assembly comprising a pair of complementary fastener strips, each of which a base from which extends a stem and a resiliently flexible, foldable hook flange projecting in normal position obliquely from the distal end of the stem toward a stiff backup shoulder rib extending from the base in the same direction as and substantially spaced from said stem;

said hook flanges being of greater length than the thickness of said stem in each instance and being resiliently flexible for folding substantially completely toward the stems; and said ribs being about the same length as the stem of each strip and the spacing between the rib and the stem of each strip providing a groove forming a socket of ample dimensions both in width and depth relative to the foldable hook flange and the stem, so that in a fastener closing maneuver the hook flange and stem of each of the complementary profiles of the fastener strips can be received slidably between the rib and the hook flange of the other strip by said folding of the foldable hook flanges toward the stem of the associated strip until the hook flanges pass one another and the foldable hook flanges then snap freely past one another back toward their normal oblique positions for interlocking of the hook flanges against separation due to bending stresses on the assembly.

11. A fastener assembly according to claim 10, wherein each of said hook flanges has an inner substantially straight surface which meets the adjacent surface of the stem from which the hook flange projects at an acute angle so that said surfaces can lie close to one another when the hook flange is folded toward the stem.

12. A fastener assembly according to claim 10, wherein each of said stems is of substantially uniform thickness throughout the major extent of its length.

13. A fastener assembly according to claim 12, including a thickened juncture of each of said stems with the respective base from which the stem projects.

14. A fastener assembly according to claim 10, wherein said hook flanges join the stems on respective thickened juncture crowns.

15. A fastener assembly according to claim 10, wherein said backup shoulder ribs have respective stiffening reinforcement junctures with said base.

16. A fastener assembly according to claim 15, wherein said stiffening reinforcement junctures comprise fillets.

17. A fastener assembly according to claim 15, wherein each of said stiffening reinforcement junctures includes a base extension and a fillet at juncture of the associated rib and extension.

18. A fastener assembly according to claim 10, wherein said stem and said rib have reinforcing juncture fillets with said bases.

19. An extruded plastic reclosable fastener assembly comprising a pair of complementary fastener strips, each of which comprises:

a base from which extends a stem and a resiliently flexible, foldable hook flange projecting in normal position obliquely from the distal end of the stem toward a stiff backup shoulder rib extending from the base in the same direction as and substantially spaced from said stem;

said hook flanges being of greater length than the thickness of said stem in each instance and being resiliently flexible for folding substantially completely toward the stems; and said ribs being about the same length as the stem of each strip and the spacing between the rib and the stem of each strip providing a groove forming a socket which is of a width which is the sum of the thicknesses of said stems and the space between the inside faces of the stems and of ample depth relative to the foldable hook flange and the stem, so that in a fastener closing maneuver the hook flange and stem of each of the complementary profiles of the fastener strips can be received slidably between the rib and the hook flange of the other strip by said folding of the foldable hook flanges toward the stem of the associated strip until the hook flanges pass one another and the foldable hook flanges then snap freely past one another back toward their normal oblique positions for interlocking of the hook flanges against separation due to bending stresses on the assembly.

20. An assembly according to claim 19, wherein said hook flanges join their respective stems at a relatively thick crown, which has a radius of curvature which about equals the thickness of the stem, the length of the stem from the top of said crown to the level of the inside surface at the bottom of the socket comprising the sum of about two times the length of the hook flange in each instance taken in a straight line between a free tip and the top point of the radius of curvature of said crown plus one-half of the thickness of the stem, the thickness of said base being about the thickness of the stem plus 20%, the length of the inside surface of each of the hook flanges being about the same as the spacing dimension between the inside surfaces of said stems in the assembly or about two times the thickness dimension of the stems, said outside length of the hook flange being about the sum of the length of the inside surface of the hook flange plus the radius of curvature of said crown, the thickness of each of said ribs being about the same as the outside length of the hook flanges, said length of the stems being about two times the outside length of the hook flange plus one-half of the stem thickness, and the thickness across the base of the hook flange being about twice the thickness of the tip end of the hook flange.

* * * * *